US005823752A

United States Patent [19]

Hoenisch et al.

[11] Patent Number: 5,823,752

[45] Date of Patent: Oct. 20, 1998

[54] ADAPTER FOR MECHANICALLY COUPLING A PUMP AND A PRIME MOVER

[75] Inventors: Herb Hoenisch; Robert D. Kern, both of Waukesha; Gerald C. Ruehlow, Oconomowoc; Wes Sodemann, Dousman, all of Wis.

[73] Assignee: Generac Portable Products, LLC, Jefferson, Wis.

[21] Appl. No.: 810,215

[22] Filed: Feb. 28, 1997

[51] Int. Cl.[6] ..... F04B 35/00

[52] U.S. Cl. ..... 417/363; 417/53; 184/6.17

[58] Field of Search ..... 417/53, 271, 359, 417/363, 364, 415; 184/6.17, 6.18, 6.28

[56] References Cited

U.S. PATENT DOCUMENTS

| | | | |
|---|---|---|---|
| 385,211 | 6/1888 | Sprague . | |
| 1,590,514 | 6/1926 | Husle . | |
| 1,942,064 | 1/1934 | Leveen | 103/118 |
| 1,974,014 | 9/1934 | Coats | 103/102 |
| 1,992,500 | 2/1935 | Morgan | 221/95 |
| 2,382,539 | 8/1945 | Brady, Jr. | 103/126 |
| 2,509,790 | 5/1950 | Stephenson | 230/139 |
| 2,849,959 | 9/1958 | Murphy | 103/87 |
| 3,667,870 | 6/1972 | Yoshida et al. | 417/357 |
| 4,002,029 | 1/1977 | Jones | 60/458 |
| 4,218,193 | 8/1980 | Mehne | 417/364 |
| 4,289,456 | 9/1981 | Ishihara | 417/364 |
| 4,530,313 | 7/1985 | Zaremba | 123/41.47 |
| 5,306,121 | 4/1994 | Heflin et al. | 417/363 |
| 5,354,182 | 10/1994 | Niemiec et al. | 417/363 |
| 5,494,414 | 2/1996 | Steinhart et al. | 417/360 |
| 5,546,901 | 8/1996 | Acker | 123/195 C |
| 5,653,584 | 8/1997 | Mazzucato et al. | 417/360 |

FOREIGN PATENT DOCUMENTS

| | | | |
|---|---|---|---|
| 870599 | 7/1949 | Germany | 417/363 |
| 5-202846 | 8/1993 | Japan | 417/363 |

*Primary Examiner*—Charles G. Freay
*Attorney, Agent, or Firm*—Jansson, Shupe, Bridge & Munger, Ltd.

[57] ABSTRACT

The disclosure involves a prime mover and a pump-mount adapter mounted thereto. The adapter includes a central housing and a plurality of arms extending radially outwardly from the housing and coupled to the prime mover. Resilient mounts are used for such coupling and a rigid compression limiter prevents such mounts from being compressed to the degree that substantial resiliency is lost. The housing contains a liquid lubricant for lubricating the pump. A resilient seal device is between the housing and the prime mover and retains the lubricant in the housing. And after assembly, the housing is maintaining in a spaced relationship to the prime mover. The new mounting arrangement permits relatively generous manufacturing tolerances while yet permitting the prime mover and adapter-mounted pump to radially and angularly "self-align" during assembly.

13 Claims, 3 Drawing Sheets

FIG. 3
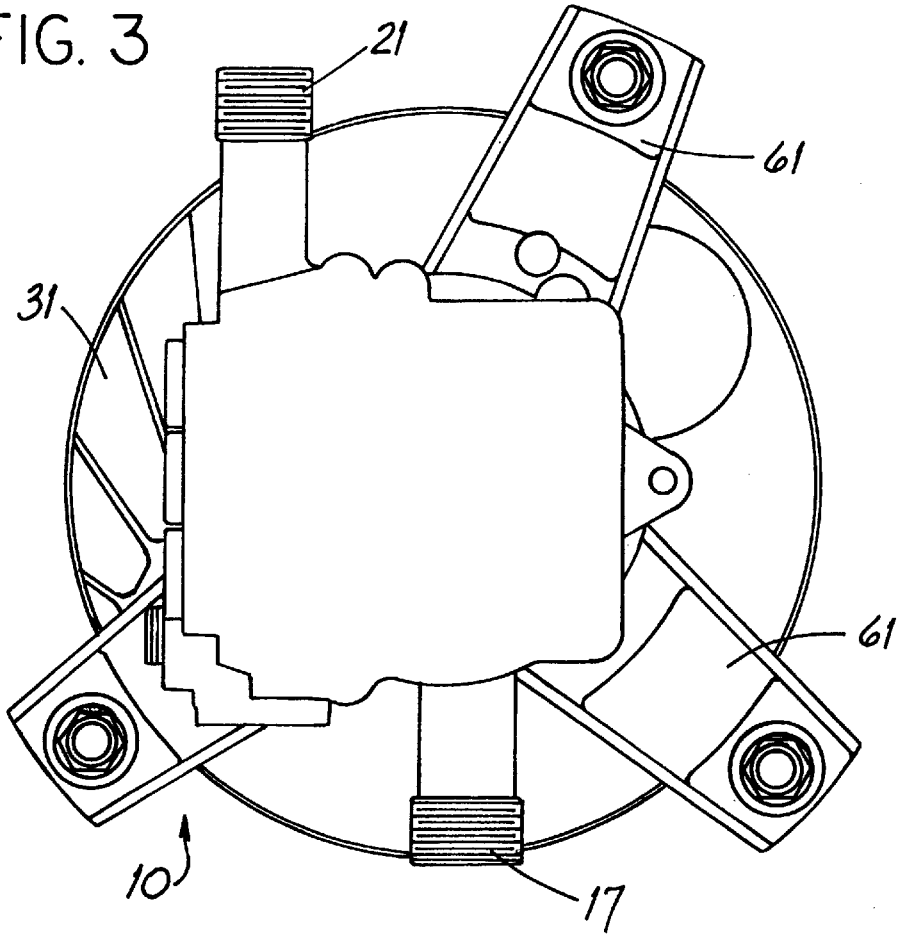
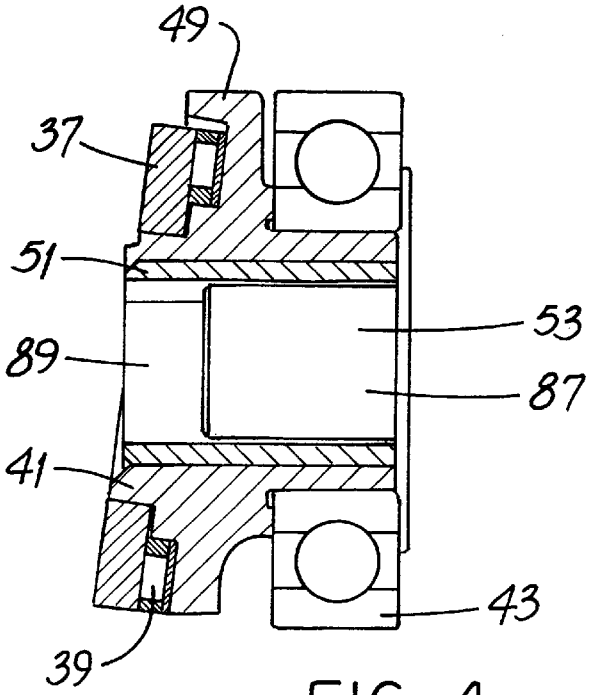
FIG. 4

ADAPTER FOR MECHANICALLY COUPLING A PUMP AND A PRIME MOVER

FIELD OF THE INVENTION

This invention relates generally to pumps and, more particularly, to pumps driven by a prime mover such as an internal combustion engine or an electric motor.

BACKGROUND OF THE INVENTION

Perhaps there is no more commonly used "tool" of industry and commerce than a broad class of machines known as prime movers. Examples include internal combustion engines and electric motors. And it is virtually as common to couple a machine of a disparate type to a prime mover to convert energy from one form to another.

For example, U.S. Pat. No. 4,218,913 (Mehne) discloses an automobile engine used to drive a hydraulic pump. This arrangement converts rotary mechanical energy into hydraulic energy, i.e., liquid under pressure.

Other exemplary patents showing prime movers mechanically coupled in axial alignment to and driving pumps include U.S. Pat. Nos. 385,211 (Sprague), 1,942,064 (Leveen) and 4,530,313 (Zaremba).

Persistent engineering and manufacturing concerns of those who couple prime mover shafts and shaft-driven machines to one another are mechanical alignment and the ease with which such alignment may be obtained. Two aspects of mechanical alignment of the prime mover driving shaft and the shaft of the driven machine involve radial shaft alignment and angular shaft alignment.

The driving and driven shafts may be said to be perfectly radially aligned and angularly aligned when their axes of rotation are coincident with one another. Such perfect alignment is ideal but not often achieved. Radial shaft misalignment refers to the dimension by which two parallel shafts are displaced radially from one another. And angular shaft misalignment refers to the angle defined by the intersecting axes of shaft rotation.

As a practical matter, it is uneconomical to hold machining tolerances so closely that radial and axial alignment cease to be of concern. And even when mating machine surfaces on a prime mover and on the product driven thereby, the typical approach is to "build in" some sort of adjustment or misalignment "forgiveness" capability.

As an example of the former, U.S. Pat. No. 5,522,536 (Kallenberger) discloses shimming gearing to align the driven gearing shaft with the drive shaft of an electric motor. And an example of the latter is a flexible coupling extending between driving and driven shafts and expressly configured to accommodate some amount of shaft misalignment. (It is no doubt apparent that the technique disclosed in the Kallenberger patent is suitable only for motors and gearing which are horizontally disposed with respect to one another.)

Another way to accommodate a degree of misalignment is illustrated in U.S. Pat. No. 5,546,901 (Acker et al.). The "hard," i.e., non-resilient, engine and generator or pump surfaces are mated to one another and engine vibration necessarily propagates to the pump, at least to some degree. Seemingly, misalignment is accommodated by providing generous clearance between the engine crankshaft and the pump swashplate.

Yet another issue faced by machine designers relates to lubrication of certain parts. In a specific application involving a vertical-shaft engine and a pressure washer pump driven by such engine, the pump has a lubricant in its casing.

In a known arrangement, an oil seal is in the pump and seals against the driven pump shaft for lubricant retention. The coacting surfaces of the engine drive shaft and the driven component of the pump are lubricated by a coating of grease. Seemingly, such lubrication is also carried out in this way in the assembly shown in U.S. Pat. No. 5,494,414 (Steinhart et al.).

A disadvantage of such arrangement is that, over time, the grease dissipates if not periodically replaced. When the grease disappears, the drive shaft and/or driven component "fret" or otherwise corrode.

An improved arrangement which eliminates certain machining operations, which nevertheless permits self-alignment of a drive shaft and the component driven thereby and which provides continuing lubrication for such shaft and component would be an important advance in the art.

OBJECTS OF THE INVENTION

It is an object of the invention to provide a prime mover/pump mount adapter that overcomes some of the problems and shortcomings of the prior art.

Another object of the invention is to provide a prime mover/pump mount adapter which reduces manufacturing costs.

Still another object of the invention is to provide a prime mover/pump mount adapter which can be used substantially "as cast," i.e., without machining those surfaces used to mount the adapter (and the pump affixed thereto) to a prime mover.

Another object of the invention is to provide a prime mover/pump mount adapter which permits mounting a pump to an engine using the engine mounting bosses "as cast" (i.e., without machining) as provided by the engine manufacturer.

Another object of the invention is to provide a prime mover/pump mount adapter which affords radial and angular shaft alignment within highly-acceptable tolerances.

Another object of the invention is to provide a prime mover/pump mount adapter which permits an engine drive shaft and the component driven thereby to self-align during assembly.

Yet another object of the invention is to provide a prime mover/pump mount adapter which, when used with an engine and a pump containing a lubricant, provides continuing lubrication for the mating surfaces of the engine drive shaft and the pump driven component.

Another object of the invention is to provide a prime mover/pump mount adapter which significantly isolates the pump from engine vibration.

Another object of the invention is to provide a prime mover/pump mount adapter which is highly suited for vertical shaft engines. How these and other objects are accomplished will become apparent from the following descriptions and from the drawings.

SUMMARY OF THE INVENTION

The invention involves a prime mover and a pump-mount adapter mounted to the prime mover and having a driven pump fixed with respect to the adapter. The adapter has a central housing and a plurality of arms extend radially outwardly from the housing. Each arm is coupled to the prime mover by a separate fastener, e.g., a bolt. A resilient mount is interposed between each arm and the prime mover and, more specifically, between each arm and a spacer bearing against a mounting plate. In addition, another resilient mount is interposed between each fastener and each arm.

The resilient mounts are around and concentric with the fastener and a rigid compression limiter is interposed between the fastener and the prime mover. Each such compression limiter is also concentric with its respective fastener and is between the mounts and the fastener.

The compression limiters help prevent the resilient mounts from being compressed (by over-tightening the fasteners) to a degree such that substantial axial and radial resiliency might be lost. Maintaining axial and radial mount resilience is highly preferred to permit "self-alignment" of the prime mover, its drive shaft and the pump mounted to the adapter and driven by such prime mover.

In another aspect of the invention, the housing also forms a component of the pump and contains a liquid lubricant. A resilient seal device is between the housing and the prime mover and retains the lubricant in the housing.

The pump has an actuator including a cam component (which reciprocates the pump pistons) and a bushing component which engages the prime mover drive shaft. In a highly preferred embodiment, the bushing component is made of powdered metal and the cam component is die cast around such bushing component.

The selected position of placement of the seal device permits the lubricant to lubricate not only a needle thrust bearing and bearing washer in the pump but to also lubricate the engaging surfaces of the drive shaft and the bushing component. And that is not all. A radial ball bearing is received in the housing and supports the actuator and the lubricant also lubricates this bearing.

In a specific embodiment to facilitate assembly, the housing has an upstanding shoulder-like retainer extending toward the prime mover. During assembly, the retainer holds the seal device in position and at the completion of assembly, the seal device is between the retainer and the drive shaft.

Another aspect of the invention involves a new method for mounting a pump having a driven bushing to a prime mover having a drive shaft. The method includes the steps of providing an adapter having a central housing and a plurality of arms extending radially outwardly from the housing. A pump is affixed to the adapter and a resilient seal device is placed on the housing. The pump bushing component is urged into engagement with the drive shaft and then each arm is coupled to the prime mover. Coupling is by placing a resilient mount between each arm and the prime mover and by affixing a fastener to each arm and the prime mover.

In a more specific aspect of the method, the coupling step includes compressing the sealing device. Such step also includes securing the fasteners while maintaining the housing in a spaced relationship to the prime mover. Other details of the invention are set forth in the following detailed description and in the drawings.

BRIEF DESCRIPTION OF THE DRAWINGS

FIG. 3 is a bottom plan view of the engine, pump and pump-mount adapter of FIG. 2.

FIG. 4 is a sectional elevation view of a portion of the pump shown in FIG. 2.

DETAILED DESCRIPTION OF PREFERRED EMBODIMENTS

Figure 1:
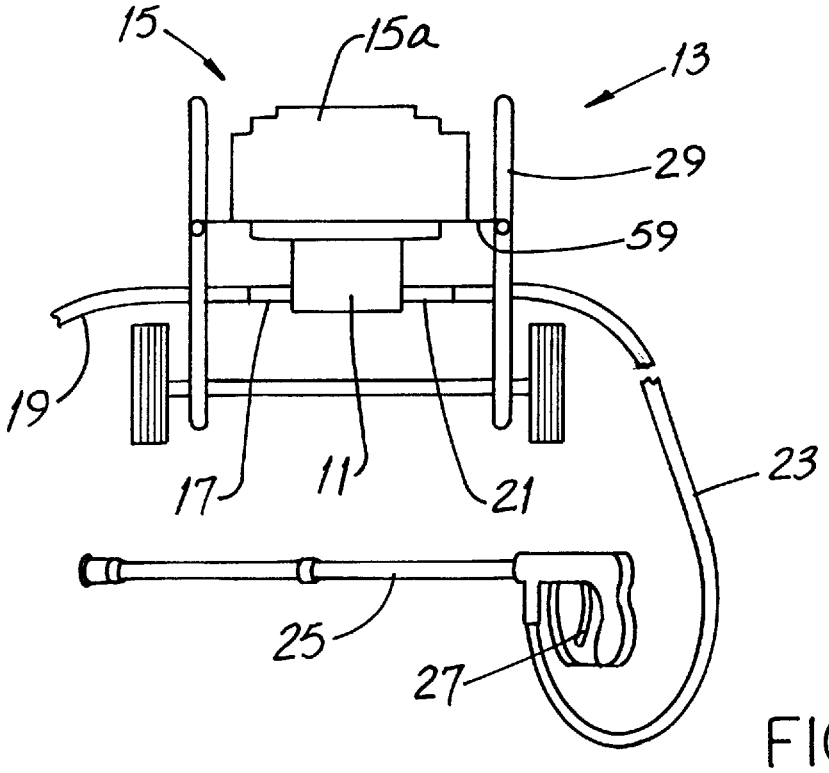
FIG. 1 is a representative elevation view of a pressure washer using a vertical shaft engine driving a pump. Parts are broken away.

Before describing the new pump-mount adapter 10 and related pump 11 in detail, it will be helpful to have an understanding of an exemplary application for such adapter 10. FIG. 1 shows a pressure washer 13 comprising a prime mover 15 embodied as an internal combustion engine 15*a* of the vertical shaft type. The pressure washer pump 11 is driven by the engine 15*a* and includes a water inlet 17 attached to a source of water, e.g., a garden hose 19.

The pump 11 also has a high pressure outlet 21 attached by hose 23 to a gun-like wand 25. The user of the washer 13 manipulates the wand 25 and its on-off "trigger" 27 to wash machinery, building surfaces, or the like. The engine 15*a* and pump 11 are supported on a wheeled cart 29 for easy mobility.

Figure 2:
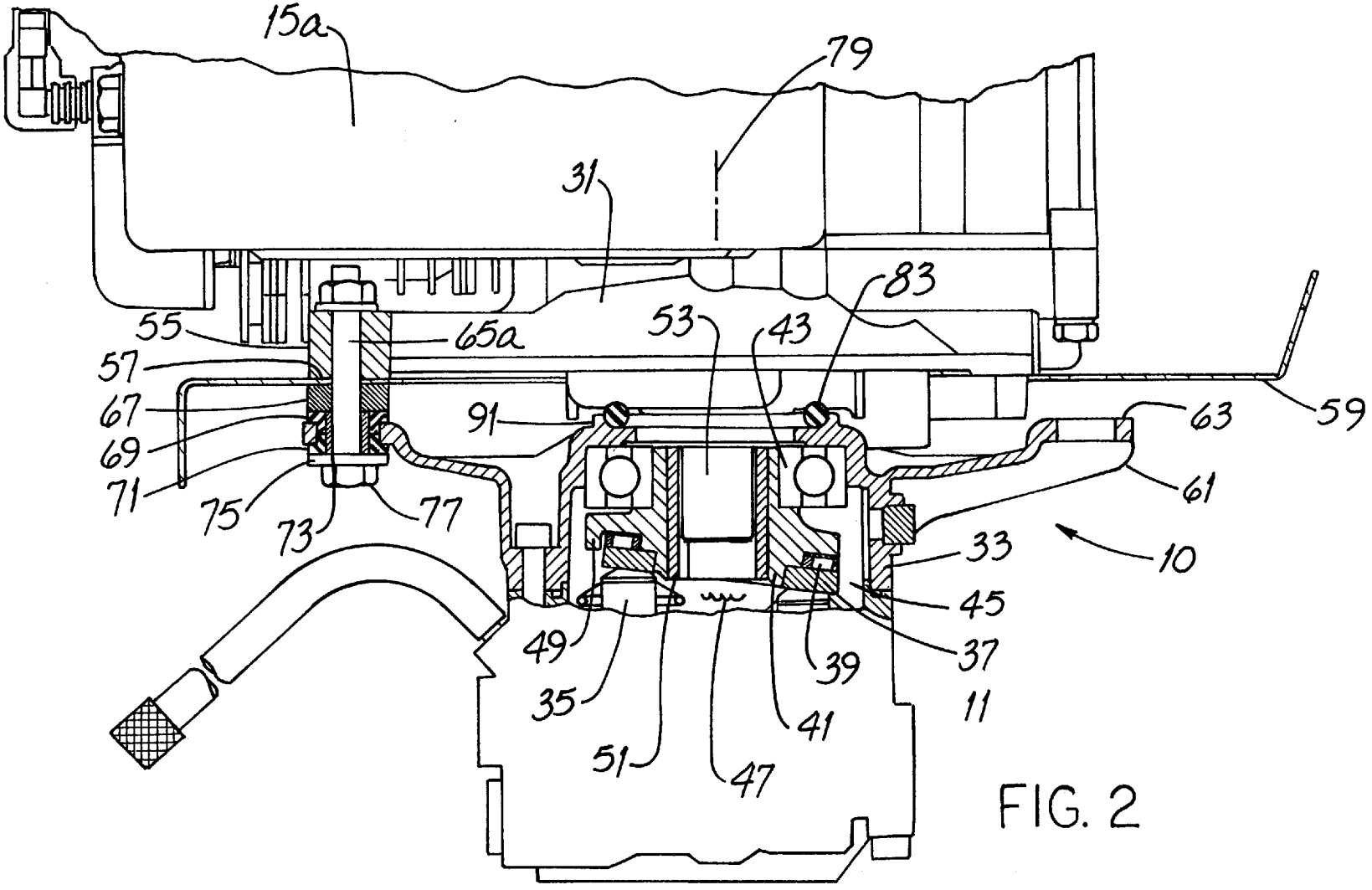
FIG. 2 is an elevation view, partly in section and partly in full representation, of a vertical shaft engine and pump driven by such engine and mounted thereto by the new pump-mount adapter. Parts are broken away.

Referring next to FIGS. 2, 3 and 4, the new pump-mount adapter 10 is coupled to the lower casting 31 of the engine 15*a*. In the case of a four-cycle engine 15*a*, such casting defines the sump containing oil for lubricating internal engine parts.

The pump 11 is affixed to the adapter housing 3 and includes plural pistons 35, a bearing washer 37, a needle-type thrust bearing 39 and a rotatable actuator 41 which reciprocates the pistons 31. A ball bearing 43 is received in the housing 33 and supports the actuator 41. The cavity 45 formed by the housing 33 and the pump 11 has a quantity of gear lube oil 47 contained therein and such oil 47 lubricates the parts described above and also lubricates other parts as described below.

The actuator 41 includes a cam component 49 and a bushing component 51, the latter engaging the prime mover drive shaft 53 as described in more detail below. In a highly preferred embodiment, the bushing component 51 is made of powdered metal and the cam component 49 is die cast around such bushing component 51 using aluminum, zinc or similar "white metal."

In a specific embodiment, the engine 15*a* is a lawn mower engine selected at least because of its relatively-low cost (such engine 15*a* is made in substantial quantities) and good durability. The oil sump casting 31 includes three mounting bosses 55, the number and locations of which are in accordance with a Society of Automotive Engineers (SAE) specification for lawn mower engines. Notably, the surfaces 57 of such bosses 55 which contact the mount plate 59 are not machined. That is, the bosses 55 are used "as cast."

Referring to FIGS. 2 through 5, details of the new pump-mount adapter 10 and related method will now be set forth. The adapter central housing 33 has a plurality of arms 61 extending radially outwardly therefrom. Notably, the surfaces 63 of the arms 61 which are toward the engine 51a are not machined. Rather, such arms 61 are also used "as cast."

The hardware used to couple each arm 61 to its respective engine boss 55 includes a fastener 65, e.g., a bolt 65*a*, and a rigid spacer 67. The thickness of the spacer 67 and whether or not such spacer 67 is used is dictated by the types of prime mover 15 to which the adapter 10 is intended to be mounted. To put it in other words, if the adapter 10 is to be used with but a single, specific engine 15*a*, the spacer 67 may be omitted and minor modifications in the arms 61 may thereby be indicated.

The coupling hardware also includes first and second resilient mounts 69 and 71, respectively, a rigid compression limiter 73 and, preferably, a washer 75 between the bolt head 77 and the second mount 71. Considered in an orientation parallel to the axis of rotation 79, each first resilient mount 69 is interposed between its respective arm 61 and the engine 15*a* and, more specifically, between each arm 61 and a mounting plate 59. Each second resilient mount 71 is interposed between each of the respective fasteners 65 and arms 61. (It should be appreciated that when the mounts 69, 71 are shaped as shown, they can be slipped over the fastener 65 one at a time and assembly is thereby expedited. However, a grommet may also be used in place of each pair of mounts 69, 71.)

Figure 5:
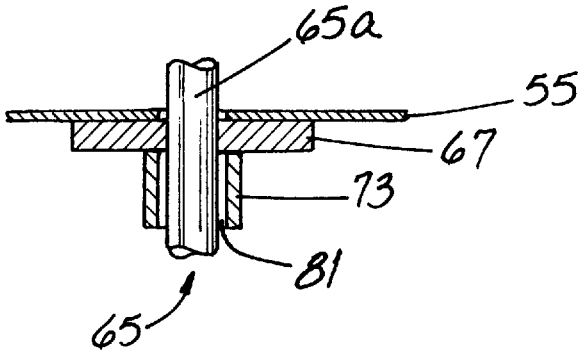
FIG. 5 is a sectional elevation view of certain hardware used to couple the pump-mount and the engine to one another.

Considered radially, i.e., in an orientation normal to the axis 79, the resilient mounts 69, 71 are around and concentric with the fastener 65. And each compression limiter 73 is also around and concentric with its respective fastener 65 and is between the mounts 69, 71 and the fastener 65. As shown in FIG. 5, there is a slight clearance 81 between each limiter 73 and its respective fastener 65, thereby better facilitating pump/engine "self-alignment" as described below.

The compression limiters 73 help prevent the resilient mounts 69, 71 from being compressed (by over-tightening the fasteners 65) to a degree such that substantial axial and radial resiliency might be lost. Maintaining axial and radial mount resilience is highly preferred to permit self-alignment of the engine 15*a*, its drive shaft 53 and the pump 11 mounted to the adapter 10 and driven by such engine 15*a*.

Referring particularly to FIG. 2, 3 and 4, the adapter housing 33 forms a component of the pump 11 and a resilient seal device 83 is between the housing 33 and the engine 15*a* and retains the oil 47 in the housing 33. A highly preferred seal device 83 is a round donut-like seal having a circular cross-section. Most preferably, such device 83 should be significantly compressible rather than substantially rigid. That is, to the extent that flat seals or gaskets are relatively incompressible and do not permit self-alignment, they are not well suited.

The selected position of the seal device 83 permits the oil 47 to lubricate not only the needle thrust bearing 39 and bearing washer 37 in the pump 11 but to also lubricate the engaging surfaces 87 and 89 of the drive shaft 53 and the bushing component 51, respectively. And that is not all. The radial ball bearing 43 is received in the housing 33 and the oil 47 also lubricates this bearing 43.

In a specific embodiment to facilitate assembly, the housing 33 has an upstanding shoulder-like retainer 91 extending toward the engine 15*a*. During assembly, the retainer 91 holds the seal device 83 in position and at the completion of assembly, the seal device 83 is between the retainer 91 and the drive shaft 53.

The new method for mounting a pump 11 includes the steps of providing the adapter 10 having the central housing 35 and a plurality of radially-outwardly-extending arms 61. To mount the adapter 10 and pump 11, it is preferred that the engine 15*a* be inverted from the views of FIGS. 1 and 2. The pump 11 is first affixed to the adapter 10 and a resilient seal device 83 is placed against the housing 33 and during assembly is retained there by the retainer 91.

The adapter 10 and pump 11 are lowered toward the engine 15*a* as the pump bushing component 51 is urged into engagement with the drive shaft 53. Each arm 61 is then coupled to the engine 15*a*. Coupling is by placing a resilient mount 69 between each arm 61 and the engine 15*a* and by affixing a fastener 65 to each arm 61 and the engine 15*a*.

In a more specific aspect of the method, the coupling step includes compressing the seal device 83. Such step also includes securing the fasteners 65 while maintaining the housing 33 in a spaced relationship to the engine 15*a* as shown in FIG. 2.

While the principles of the invention have been shown and described in connection with one or more preferred embodiments, it is to be understood clearly that such embodiments are by way of example and are not limiting.

What is claimed:

1. In combination, a prime mover and a pump-mount adapter mounted thereto, and wherein:

the adapter includes a central housing spaced from the prime mover;

a plurality of arms extend radially outwardly from the housing;

each arm is coupled to the prime mover; and a resilient mount is interposed between each arm and the prime mover.

2. The combination of claim 1 wherein:

the resilient mounts are first mounts;

each arm is coupled to the prime mover by a fastener; and a second mount is interposed between each fastener and each arm.

3. The combination of claim 2 wherein:

the mounts are around the fastener; and a rigid compression limiter is interposed between the fastener and the prime mover.

4. The combination of claim 1 wherein:

a pump is fixed with respect to the adapter;

the housing contains a liquid lubricant for lubricating the pump; and a resilient seal device is between the housing and the prime mover and retains the lubricant in the housing.

5. The combination of claim 4 wherein:

the prime mover has a drive shaft extending into the housing and having a shaft surface;

the pump includes an actuator coupled to the drive shaft and having an actuator surface adjacent to the shaft surface; and the lubricant lubricates the surfaces.

6. The combination of claim 5 wherein:

the actuator includes a cam component and a bushing component;

the components are made of dissimilar materials; and the cam component is cast around the bushing component.

7. The combination of claim 5 wherein:

a bearing is received in the housing and supports the actuator; and the lubricant lubricates the bearing.

8. The combination of claim 4 wherein:

the prime mover has a drive shaft extending into the housing;

the housing has a retainer extending toward the prime mover; and the seal device is between the retainer and the drive shaft.

9. The combination of claim 1 wherein:

a pump is fixed with respect to the adapter and includes (a) a plurality of pistons, and (b) an actuator for driving the pistons;

a bearing is received in the housing and supports the actuator.

10. The combination of claim 9 wherein the housing contains a lubricant which lubricates the bearing.

11. A method for mounting a pump having a driven bushing to a prime mover having a drive shaft, the method including the steps of:

providing an adapter having a central housing and a plurality of arms extending radially outwardly from the housing;

affixing the pump to the adapter;

placing a resilient seal device on the housing;

sliding the bushing into engagement with the drive shaft; and coupling each arm to the prime mover by placing a resilient mount between each arm and the prime mover and affixing a fastener to each arm and the prime mover.

12. The method of claim 11 wherein the coupling step includes compressing the sealing device.

13. The method of claim 12 wherein the coupling step also includes securing the fasteners while maintaining the housing in a spaced relationship to the prime mover.

* * * * *